United States Patent [19]

Walters

[11] 4,329,120

[45] May 11, 1982

[54] PUMP PROTECTOR APPARATUS

[76] Inventor: William Walters, 910 W. Caddo, Cleveland, Okla. 74020

[21] Appl. No.: 143,355

[22] Filed: Apr. 24, 1980

[51] Int. Cl.[3] ..... F04B 49/00

[52] U.S. Cl. ..... 417/12; 417/38; 417/43

[58] Field of Search ..... 417/36, 38, 40, 43, 417/44, 12, 9, 33, 32

[56] References Cited

U.S. PATENT DOCUMENTS

| | | | |
|---|---|---|---|
| 2,275,066 | 3/1942 | Otterbourg | 417/38 X |
| 2,550,093 | 4/1951 | Smith | 417/43 |
| 2,690,291 | 9/1954 | Taylor | 417/33 |
| 2,707,440 | 5/1955 | Long et al. | 417/32 X |
| 3,274,940 | 9/1966 | Cottrell | 417/43 |
| 4,119,865 | 10/1978 | Elderton | 417/43 X |
| 4,180,374 | 12/1979 | Bristow | 417/12 |

*Primary Examiner*—Carlton R. Croyle
*Assistant Examiner*—Edward Look
*Attorney, Agent, or Firm*—Head & Johnson

[57] ABSTRACT

A pumping system protection device which continuously monitors the rate of flow from a pump, which provide pressurized liquid from a pump to a tank, through a check valve, such as can be used in a water well, for example, to provide water to a pressurized receiving tank. An orifice of selected small size is provided in the flow line means to the check valve and receiving tank. The purpose of this orifice is to bleed the pressure in the flow line whenever the pump stops delivering liquid. The pressure in the flow line at the point of the orifice is monitored by a pressure sensitive switch, which closes a contact when the pressure is below a selected small value. The contact controls power to the pump motor. If there is no liquid flow the contacts open, and power to the pump is cut off. If when the power switch is closed and liquid flows from the pump, the pressure sensitive switch will open its contact and leave the power switch in the closed position. When the flow stops and the pressure drops at the orifice, the pressure sensitive switch closes, which opens the power switch.

5 Claims, 2 Drawing Figures

PUMP PROTECTOR APPARATUS

BACKGROUND OF THE INVENTION

1. Field of the Invention

This invention lies in the field of pumping systems. More particularly, it concerns protection mechanism for pumping systems and provides protection to the motor and pump in case of failure of flow of liquid while the pump is running.

2. Description of the Prior Art

In the prior art a system has been used, which utilizes a check valve as a means for monitoring flow in the output line from a pump. The check valve controls the power to the pump motor, opening the power circuit whenever the pump fails to produce a flow of liquid while it is running. There are numerous disadvantages to this system based on a check valve as a flow-sensor. However, applicant knows of no prior art which provides all of the features of the present invention.

SUMMARY OF THE INVENTION

It is a primary object of this invention to provide a protection system, to be added to a pumping system, which provides a pump for delivering pressurized liquid from a sump to a storage means.

It is a further object of this invention to provide a positive means for determining whether liquid flow is occuring or not, and responsive to the flow, controlling the power to the pump.

It is a still further object of this invention to monitor the flow from the pump by means of an orifice in the flow line upstream of the check valve, and to provide a pressure sensitive switch connected into the flow line at that point, and responsive to the pressure sensitive switch, to cut off the power to the pump, whenever the flow stops for any other reason than the removal of power from the pump motor.

These and other objects are realized, and the limitations of the prior art are overcome in this invention, by providing in a pumping system in which a pump is powered to pressurize a liquid and drive it from a sump to flow through a flow line to a receiving tank through a check valve.

The improvement includes an orifice in the flow line from the pump to the check valve and the tank. This orifice is of selected small size positioned upstream of, and near to the check valve. Its purpose is to bleed off liquid from the flow line (to return to the sump) so that when flow stops the pressure in the flow line at that point will drop to atmospheric pressure. The contacts in the pressure sensitive switch means (PSSM) are normally closed when the pressure applied to the PSSM is less than a certain minimum value. The contacts in the PSSM, control a power switch to control power to the pump. If the flow of liquid through the flow line stops, then the contacts in the PSSM open the power switch that controls the pump, to shut off the pump and protect it and the drive motor.

If the pump motor and pump are running and there is insufficient fluid level in the sump, so that the pump is not pumping, or if there is gas in the line which prevents the flow of the liquid, or if the pump has lost its prime and is running but is not pumping, then the pressure sensitive switch means will determine that there is something wrong, and will control the power switch to open and shut down the pump. This type of protection will serve to prevent possible burnouts of the pump motor, and will prevent damage to the pump, packings, etc.

Means are provided also for recycling at selected time intervals the closing of the power switch to the pump to see whether or not in the intervening delay period that the difficulty which prevented flow and caused shut down, has cured itself. If after the selected time period, the power switch is again closed and the pump runs, and if liquid flows the pump continues to run, since the PSSM is open and pumping continues. However, if at any time the flow stops while the pump is running, then the orifice in combination with the PSSM serves to stop the pump. The power switch for the pump can be an electrical relay controlled switch, which has a coil powered through the contacts of the PSSM. The contacts of the relay are normally closed, held in that position by a spring, but can be opened by application of power to the coil, which is responsive to the contacts of the PSSM.

An alternate and improved type of power switch mechanism for controlling the power to the pump would involve a small motor driven cam which closes a power switch. The small motor is normally in the position in which the power switch remains closed, and so long as the pump is producing a flow of pressurized liquid, the PSSM contacts remain open, and the cam motor does not run, and the cam keeps the power switch closed. However, if the flow from the pump stops, then the PSSM closes, driving the motor and cam to open the power switch. So long as the pressure is low, indicating that there is no flow of liquid in the flow line, the cam motor continues to run, and after a cycle period of selected time length, the cam again closes the motor switch. If the pump starts to produce liquid flow the cam motor is stopped and the pump continues running.

BRIEF DESCRIPTION OF THE DRAWINGS

These and other objects and advantages of this invention and a better understanding of the principles and details of the invention will be evident from the following description taken in conjunction with the appended drawings in which.

DETAILED DESCRIPTION OF THE PREFERRED EMBODIMENT

Figures 1, 2:
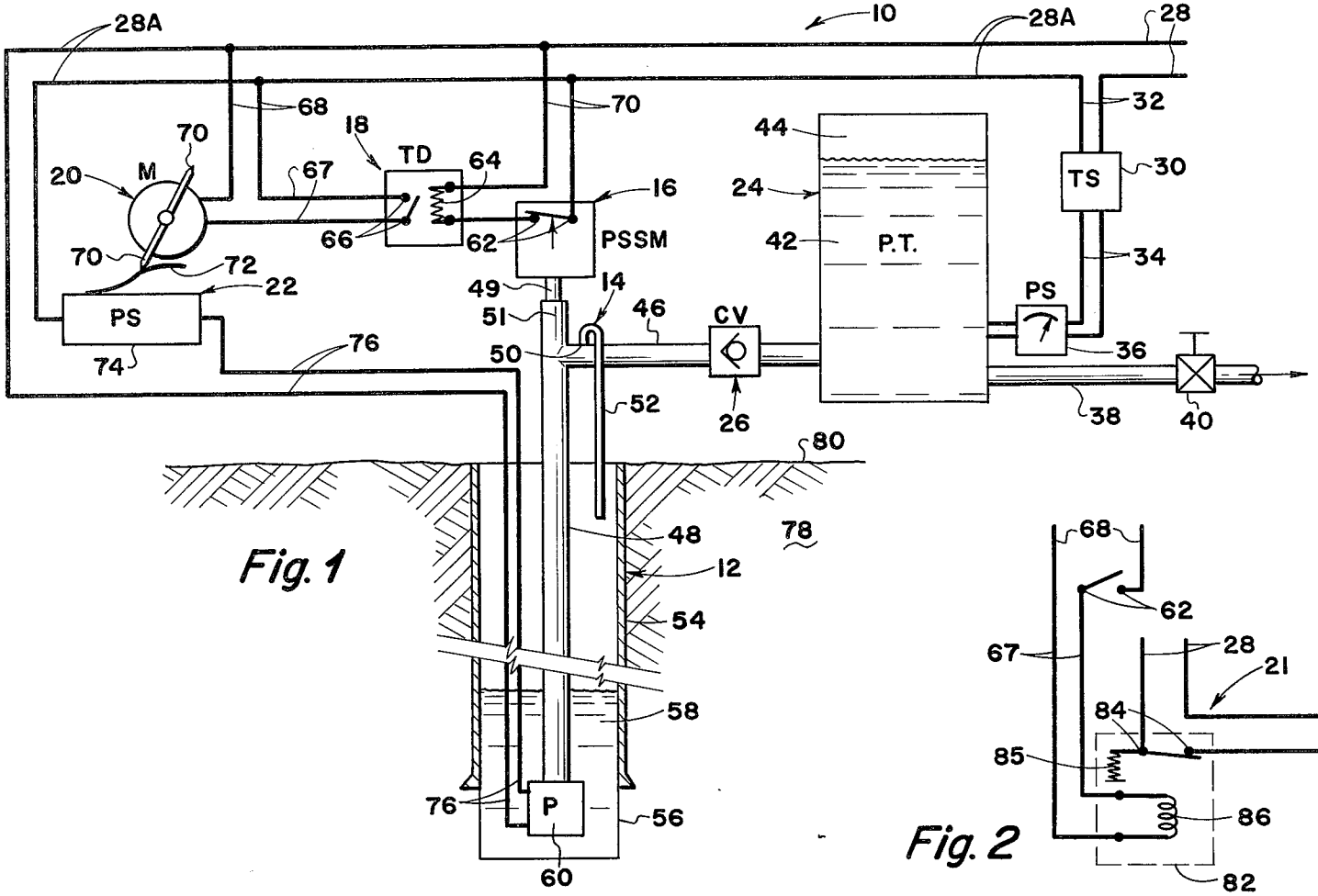
FIG. 1 represents in schematic form, a diagram of apparatus in accordance with this invention.
FIG. 2 shows an alternative type of power switch for the pump.

Referring to the drawings, and in particular to FIG. 1, there is shown in schematic form one embodiment of this invention. Indicated generally by the numeral 10 is the overall system. Numeral 12 indicates the well system, numeral 14 indicates generally an orifice and bleed connection of the flow line, numeral 16 indicates a pressure sensitive switch means PSSM numeral 18 a time delay means, numeral 20 indicates a motor driven cam means, which controls a power switch means indicated generally by the numeral 22.

The pump 60 is inserted into a well 54 which may be cased to a selected depth, below the surface 80 of the earth 78. The pump 60 is supplied with electrical power through conductors 76 from the surface 80, and supplies pressurized liquid 58 from the bottom of the well. The pressurized liquid flows up the flow line 48 and a connecting second flow line 46, through a check valve 26 to a tank or other receiver.

Indicated generally by the numeral 24 is a pressurized tank having liquid 43, to a selected level 43, which compresses a gas 44 so as to maintain a selected pressure on the liquid, and on the output line 38 controlled by valve 40. The pressure in the tank is, of course, the pressure provided by the pump, minus the pressure head of liquid from the pump to the level of the flow line 46.

The check valve 26 is normally supplied to prevent the backflow of liquid from the tank, whenever the pump is shut down, for any reason.

The purpose of this control mechanism to be described, is to continuously monitor the flow lines 48 and 46, so that when power is supplied to the pump drive through line 76, if the corresponding flow lines are filled with liquid at a selected pressure, then the control system is inactive. However, if the pump is powered through a power switch means 22, for example, and the pressure in the flow line at point 51 is less than a selected minimum, the control system operates to shut off the power to the pump.

The pressure sensitive switch means 16 is connected to a small pipe 49 to the portion 51 of the flow line 48. Incidentally, the portion 49 of the piping can be a small diameter tubing, of any selected length so that the pressure PSSM and electrical contacts can be positioned at some distance from the well. This is helpful, particularly in cases where the well 12 is an oil well and there may be combustible gases rising from the well so that explosion protected electrical apparatus would be required.

For purpose of illustration, the (PSSM) 16 is positioned close to the flow line and has a pair of contacts 62 which are normally closed.

When the pressure in the portion 51 of the flow line 46 exceeds a selected minimum (which may of course be atmospheric, or zero gauge pressure), indicating liquid flow, the contacts will open and will remain open as shown by arrow 61, so long as the pressure is greater than this minimum value. When the pump is operating normally, the pressure of liquid in the flow line will be much higher than this minimum. However, the pump maybe unable to pump the liquid, either because the motor is stalled, or because the liquid level in the well is too low to reach the inlet to the pump, or the pump is filled with gas and cannot pump liquid, or the pump has lost its prime, and so on. Although power maybe provided to the drive motor, if the pump does not produce a corresponding flow of pressurized liquid, then the PSSM contacts 62 will close.

These contacts of the PSSM 16 are powered through conductors 70 from the main power line 28A, and provide power to a time delay means 18. Any type of time delay switch could be used such as, for example, one in which a thermal heater 64 is provided with power by the PSSM 16 through the contacts 62, and when it heats, the arm of the contacts 66 will close. This delay can be set to any selected short period such as 10 to 15 seconds, or that order of time delay.

There is a small motor driven cam, which utilizes a motor 20 and a pointed cam 70 may have one, two, or more lobes. The motor and cam is positioned fixedly with respect to power switch means 74, so that as the cam 70 turns it presses down the operating lever 72, to close the switch 74. When the switch 74 closes, the power line 28A is connected through the switch 74 to the line 76 and to the pump. If the motor turns the cam beyond the lever 72, which takes approximately 10 seconds to traverse, then the switch 74 opens and removes power from the pump.

The time delay means 18 is optional, and the system can be used with or without the relay. If the relay is removed, then the motor 20 is responsive instantaneously to the closure of contact 62, and after ten seconds, for example, the switch 74 will open and remove power from the pump. Of course, with no power to the pump, there will be no pressure at the point 51, and the contacts 62 remain closed, and the motor 20 continues to run.

Near the high point of the flow line 48 and 46 is a small orifice 50 which is connected through a small diameter flow line 52 to bleed off a small amount of liquid from the flow line. The purpose of this is to ensure that when the pump is not running and the check valve 26 is closed, the pressure in the flow line 46 will be reduced to atmospheric pressure.

Of course, a very small amount of liquid will flow continuously through the orifice and flow line 52 whenever the pump is running. But since that amount is a very small fraction of the output of the pump, the efficiency of the pumping system is not seriously limited. However in combination with the check valve 26 is does positively convert flow to pressure at the point 51 in that if flow stops the pressure drops to atmospheric so that the PSSM can close its circuit, so that its control operation can function.

The purpose of the time delay relay is to withhold control signals to the motor 20 for a selected short period of time, in order to avoid a false signal resulting from such effects as a bouncing or chattering check valve 26, or other cause. Normally when the flow of pressurized liquid from the pump through the check valve stops, the flapper of the check valve should close and stay closed and this then permits the orifice 50 to bleed sufficient fluid to drop the pressure at 51 to a low enough value to operate the PSSM 16. However, if the valve flapper bounces or chatters the low pressure may not occur. Or there will be a corresponding fluctuation or chattering of the contacts 62, which if they control the motor 20 directly may provide some false starts that would not follow the proper procedure for the control of the pump.

While the time delay relay is optional, the orifice 50 is not optional and, is required to provide a positive drop in pressure at the input to the PSSM 16, whenever the flow of pressurized liquid from the pump stops.

The source of power shown at 28, may pass through a time switch 30, which can be used to close a circuit to conductors 28A to initiate the pump 60. Alternatively conductors 32 can continue as conductors 34 to a pressure switch 36 which can close contacts across the two conductors 34 when the pressure in the tank 24 is less than a selected pressure. The closing of the contacts in the pressure switch 36 then provides power on the conductors 28A, and initiates current through the power switch 74 to conductors 76 to the pump 60, provided the control mechanism is cooperative. If not, power is also supplied from the conductors 28A to the PSSM 16, and to the motor 20 and cam 70 as previously described.

FIG. 2 illustrates an alternative type of power switch 82 to replace the power switch 74. The power switch 82 is in the form of a magnetically operated switch or contactor, with an operating coil 86 and a movable electrode that rotates to connect between the two contacts 84, responsive to the spring 84, whenever there is no magnetic pull. However, when there is a current through the coil 86, arriving over conductors 68 through the PSSM contacts 62 of the PSSM the contacts 84 will be disconnected and power will be removed from pump 60.

FIG. 2 operates identically to the portion of FIG. 1 utilizing the motor 20, cam 70 and switch 74, except that no method is shown in FIG. 2 for recycling the opening and closing of the contacts 84 that is found to be so useful in connection to FIG. 1.

While the schematic diagram of FIG. 1 illustrates the invention in terms of a pump inserted into a water well 12 having water 58 at a selected level, with the pump inlet below that level, it could equally well be used in other situations where the pump operates to keep liquid emptied from a sump, and so on. Alternatively, it also could be used in connection with an oil well pump, to monitor the flow of oil, to be certain that the power is removed from the pump when it fails to produce liquid.

While I show the pump flow line connected to a pressurized tank, such as might used in a water system, any type of liquid receiver can be used, such as an unpressurized tank, etc.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In a pumping system in which a pump is powered to pressurize a liquid from a sump, to flow to a tank through a first pipe and a check valve;

apparatus for controlling the power to said pump whenever power is applied to said pump but pressurized liquid fails to arrive at said tank, comprising;

(a) an orifice in said first pipe going from said pump to said check valve and said tank, said orifice positioned upstream of, and near said check valve, to bleed off liquid from said first pipe;

(b) pressure sensitive switch means (PSSM) connected to said first pipe near said orifice, said PSSM adapted to control the power to said pump when there is no pressure, and no flow of liquid, from said pump to said check valve;

(c) power switch means for applying power to said pump means, said power switch means comprises;

(1) motor and cam means responsive to said PSSM to run when said PSSM is closed;

(2) power switch for applying power to said pump means, said power switch responsive to said motor and cam means; and (d) time delay means between said PSSM and said power switch means.

2. The pumping system as in claim 1 including time delay means in series between said PSSM and said power switch means, to provide a selected small time delay between the closure of said PSSM and the opening of said power switch means.

3. The pumping system as in claim 1 in which the power source for said pump is controlled by a pressure switch responsive to the pressure of liquid in said tank.

4. The pumping system as in claim 1 in which the power source for said pump is controlled by a time clock.

5. The pumping system as in claim 1 in which said motor and cam means is adapted to cyclically reapply power, by means of said power switch to said pump means, at selected timed intervals.

* * * * *